US009336757B2

(12) United States Patent
Chen

(10) Patent No.: US 9,336,757 B2
(45) Date of Patent: May 10, 2016

(54) SHOULDER REST FOR VIOLIN/VIOLA

(71) Applicant: Kuan-Hung Chen, Taipei (TW)

(72) Inventor: Kuan-Hung Chen, Taipei (TW)

( * ) Notice: Subject to any disclaimer, the term of this patent is extended or adjusted under 35 U.S.C. 154(b) by 0 days.

(21) Appl. No.: 14/512,629

(22) Filed: Oct. 13, 2014

(65) Prior Publication Data

US 2016/0104468 A1 Apr. 14, 2016

(51) Int. Cl.
*G10D 3/18* (2006.01)
*G10D 1/02* (2006.01)

(52) U.S. Cl.
CPC ... *G10D 3/18* (2013.01); *G10D 1/02* (2013.01)

(58) Field of Classification Search
CPC ..... G10D 3/18; G10D 1/02; G10D 1/005; G10G 5/00
USPC ..... 84/279–281
See application file for complete search history.

(56) References Cited

U.S. PATENT DOCUMENTS

2014/0290460 A1* 10/2014 Vochezer ..... G10D 3/18 84/280

* cited by examiner

*Primary Examiner* — Kimberly Lockett
(74) *Attorney, Agent, or Firm* — Jackson IPG PLLC; Demian K. Jackson

(57) ABSTRACT

A shoulder rest structure for a violin and a viola is disclosed. The shoulder rest structure comprises a first body and a second body. The first body has a positioning piece in which the positioning piece has a first connecting part and a first counterpart connected to two ends thereof. The first connecting part connects at least one first adjustment piece; the first counterpart connects at least one second adjustment piece. The second body has a first side and a second side; the first side of the second body attaches to the first body correspondingly. By means of the ergonomic design of the present invention, the violin/viola practice is made more comfortable and the length of the shoulder rest can be adjusted by the user according to requirements.

6 Claims, 8 Drawing Sheets

SHOULDER REST FOR VIOLIN/VIOLA

BACKGROUND OF THE INVENTION

1. Field of the Invention

The present invention relates to a shoulder rest structure for a violin and a viola, which meets the ergonomics and makes violin/viola practice more comfortable.

2. Description of Prior Art

The currently popular shoulder rest structure for a violin and a viola serves two functions. One is to improve the gesture of holding the violin/viola. For a person having a shorter neck, the distance from the chin to the clavicle is larger than the summation of the thickness of the violin and the height of the chin rest. To clamp the violin in a most comfortable position, the person has to lift the shoulder slightly, turn the head left, or tilt the head down. Whatever way is taken, the shoulder is kept in tension. If such a tense gesture remains for a long time, the person is prone to suffer from a shoulder injury. Therefore, a shoulder rest can be used to mitigate this situation.

Besides, the back plate is the most expensive plate in a violin. The stripes and the origin place of the back plate are key points to determine the value and the timbre of the violin. If a shoulder rest is not used when the violin is playing, the shoulder contacts the back plate directly. At this moment, forces are exerted to clamp the violin by the shoulder and the chin at the same time. As a result, the violin is clamped and the vibration of the back plate is then dampened. If a shoulder rest is used, two legs of the shoulder rest hold the edge of the back plate firmly and keep the back plate a distance away from the shoulder. In this way, the back plate can vibrate freely to obtain a resonance effect.

Please refer to FIG. 1, this prior art comprises a shoulder rest 11 which can be placed on the shoulder of a performer. Adjustments pieces 12 are disposed at two ends of the shoulder rest 11. Although the adjustment pieces 12 can be used for angle adjustment, the shoulder rest 11 is heavier and has poor softness due to its material. Also, the adjusted angle is limited when the shoulder rest 11 is placed on the shoulder, resulting in poor sound quality during the violin playing. The violin body is fixed on the adjustment pieces 12 at two ends thereof. The higher pressure applied by the adjustment pieces 12 to fix the violin body causes insufficient resonance and makes the playing sound faint and muffled. In addition, the violin is prone to tilt when the angle adjustment is made. Also, when the shoulder rest 11 contacts the violin/viola, the paint on the surfaces of the violin/viola body is likely to peel and consequently the sound quality is affected.

In addition, for the shoulder rest structure used in a violin and fabricated using the current technical skills, the practitioner has to press against the tail of the violin with the neck, hold the neck of the violin with one hand, and hold the bow with the other hand. Such a design of the shoulder rest structure is likely to make the practitioner suffer from a sore stiff neck and to cause the head to tilt. After a long time, the shoulder of the practitioner is also likely to tilt, affecting the effective time and quality of the violin practice.

In summary, the prior art has the following disadvantages.

1. A sore stiff neck is likely suffered.
2. The effective time and quality of the violin practice is decreased.
3. The length of the shoulder rest cannot be adjusted at will.
4. The sound quality is affected.

Therefore, how to overcome the above problems and disadvantages of the prior art is the focus which the inventor and the related manufacturers in this industry have been devoting themselves to.

SUMMARY OF THE INVENTION

Thus, to effectively overcome the above problems, one objective of the present invention is to provide a shoulder rest structure for a violin and a viola, which meets the ergonomics and makes violin/viola practice more comfortable.

Another objective of the present invention is to provide a shoulder rest structure for a violin and a viola, which improves the effective time and quality of the violin/viola practice.

Still another objective of the present invention is to provide a shoulder rest structure for a violin and a viola in which the length the shoulder rest can be adjusted according to the arc of the human shoulder.

Yet still another objective of the present invention is to provide a shoulder rest structure for a violin and a viola, which enhances the sound quality of the violin/viola.

To achieve the above objectives, the present invention provides a shoulder rest structure for a violin and a viola, which comprises a first body and a second body. The first body has a positioning piece; the positioning piece has a first connecting part and a first counterpart at two ends thereof; the first connecting part connects at least one first adjustment piece and the first counterpart connects at least one second adjustment piece. The second body has a first side and a second side; the first side of the second body attaches to the first body correspondingly By means of the design of the structure of the present invention, the practitioner can use the design of such a flexible shoulder rest structure to adjust the length of the shoulder rest according to different curvatures of the outlines of the shoulders. As a result, the practitioner will not feel uncomfortable due to tilting the head or raising the shoulder for a long time, which meets the ergonomics and makes the practitioner not easy to get tired, which further extends the effective time and improves the quality of the violin practice, and enhances the sound quality.

DETAILED DESCRIPTION OF THE INVENTION

The above objectives of the present invention and the features of structure and function of the present invention are described according to the preferred embodiments in figures.

Figure 1:
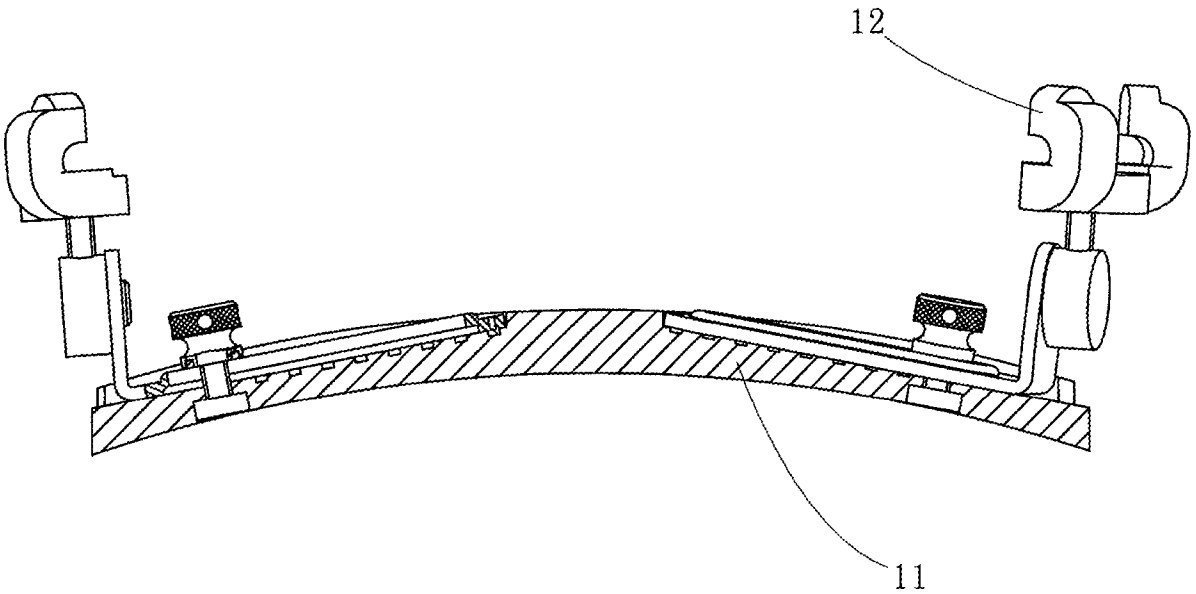
(PRIOR ART) Fig. 1
FIG. 1 is a cross-sectional view of the traditional shoulder rest structure of the violin.
Figure 2:
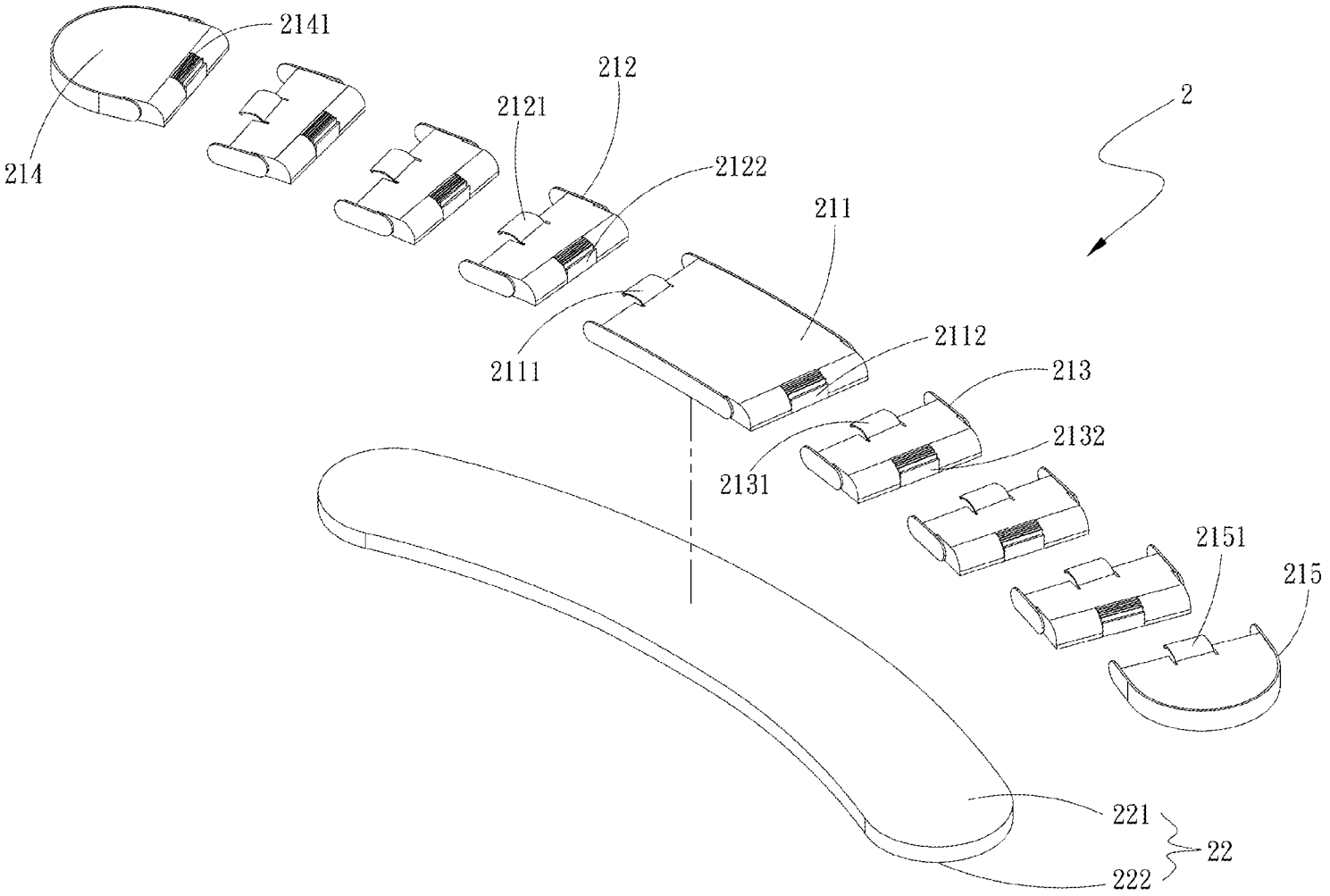
FIG. 2 is a perspective exploded view of the shoulder rest structure for a violin and a viola according to the first embodiment of the present invention.
Figure 3:
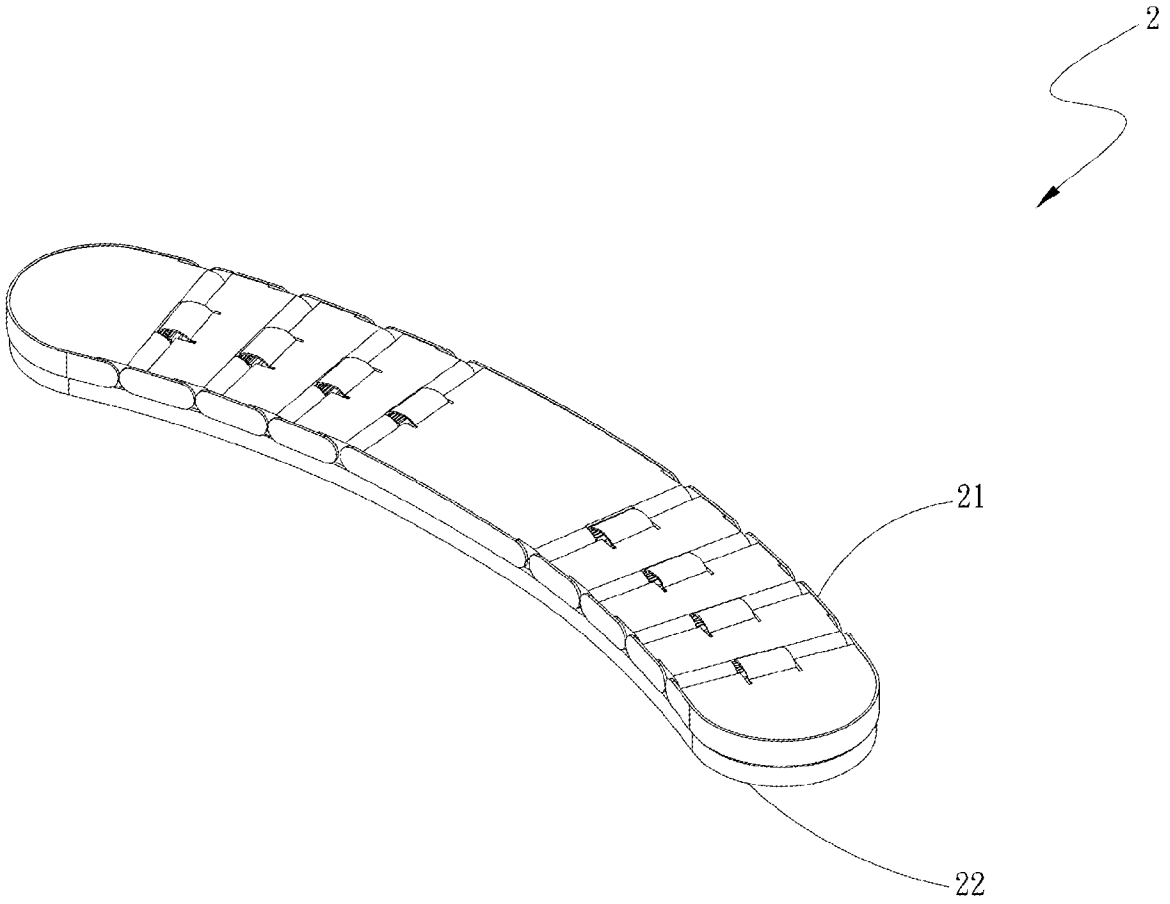
FIG. 3 is a perspective assembled view of the shoulder rest structure for a violin and a viola according to the first embodiment of the present invention.

Please refer to FIGS. 2 and 3, which are the perspective exploded and perspective assembled views of the shoulder rest structure for a violin and a viola according to the first embodiment of the present invention, respectively. As shown in FIGS. 2 and 3, the shoulder rest structure 2 comprises a first body 21 and a second body 22. The first body 21 has a positioning piece 211; the positioning piece 211 has a first connecting part 2111 and a first counterpart 2112 at two ends thereof; the first connecting part 2111 connects at least one first adjustment piece 212 and the first counterpart 2112 connects at least one second adjustment piece 213. The second body 22 has a first side 221 and a second side 222; the first side 221 attaches to the first body 21 correspondingly.

The materials of the above-mentioned first body 21 and the second body 22 are metal or nonmetal.

The first adjustment piece 212 has a second connecting part 2121 and a second counterpart 2122 at two sides thereof. The first connecting part 2111 is engaged with the second counterpart 2122 correspondingly. The second adjustment piece 213 has a third connecting part 2131 and a third counterpart 2132 at two sides thereof. The first counterpart 2112 is engaged with the third connecting part 2131 correspondingly.

The present invention further comprises a third adjustment piece 214 and a fourth adjustment piece 215. The third adjustment piece 214 correspondingly connects the first adjustment piece 212. The third adjustment piece 214 has a fourth counterpart 2141 at a side thereof and the fourth counterpart 2141 is correspondingly engaged with the second connecting part 2121 of the first adjustment piece 212 at the farthest end.

The fourth adjustment piece 215 correspondingly connects the second adjustment piece 213. The fourth adjustment piece 215 has a fourth connecting part 2151 at a side thereof and the fourth connecting part 2151 is correspondingly engaged with the third counterpart 2132 of the second adjustment piece 213 at the farthest end.

Figure 4:
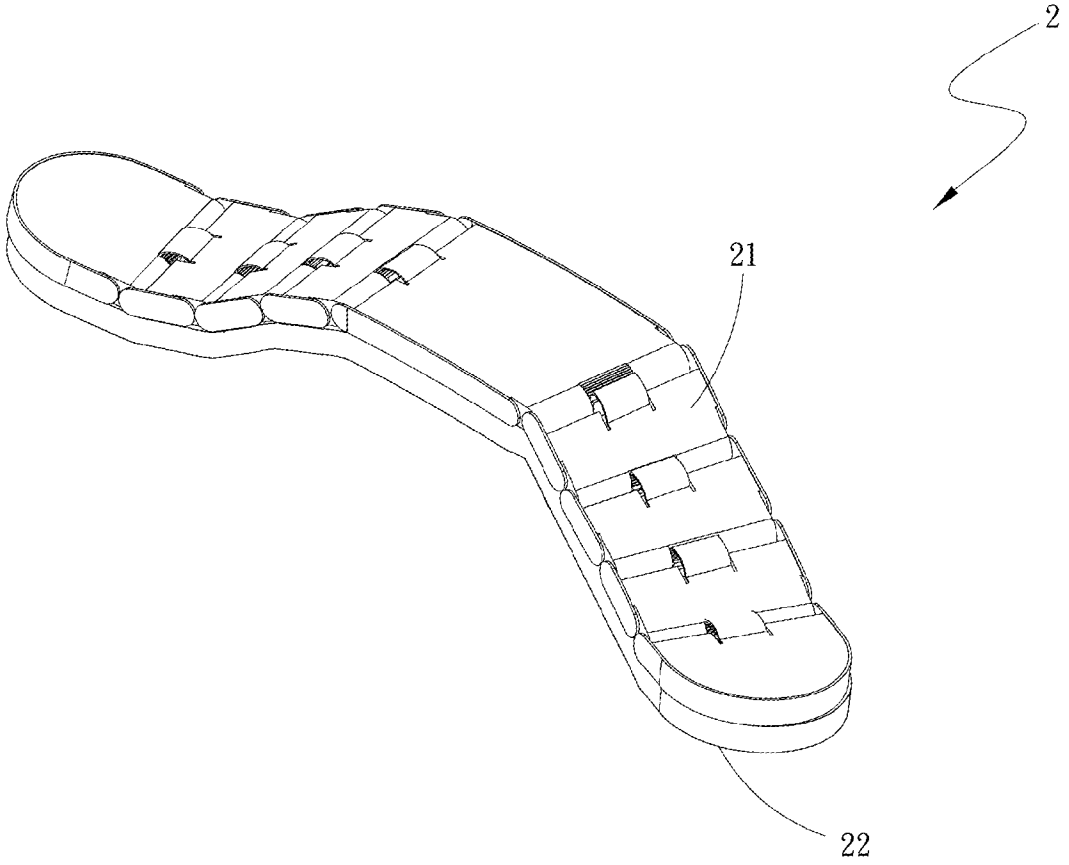
FIG. 4 is another perspective assembled view of the shoulder rest structure for a violin and a viola according to the first embodiment of the present invention.
Figure 5:
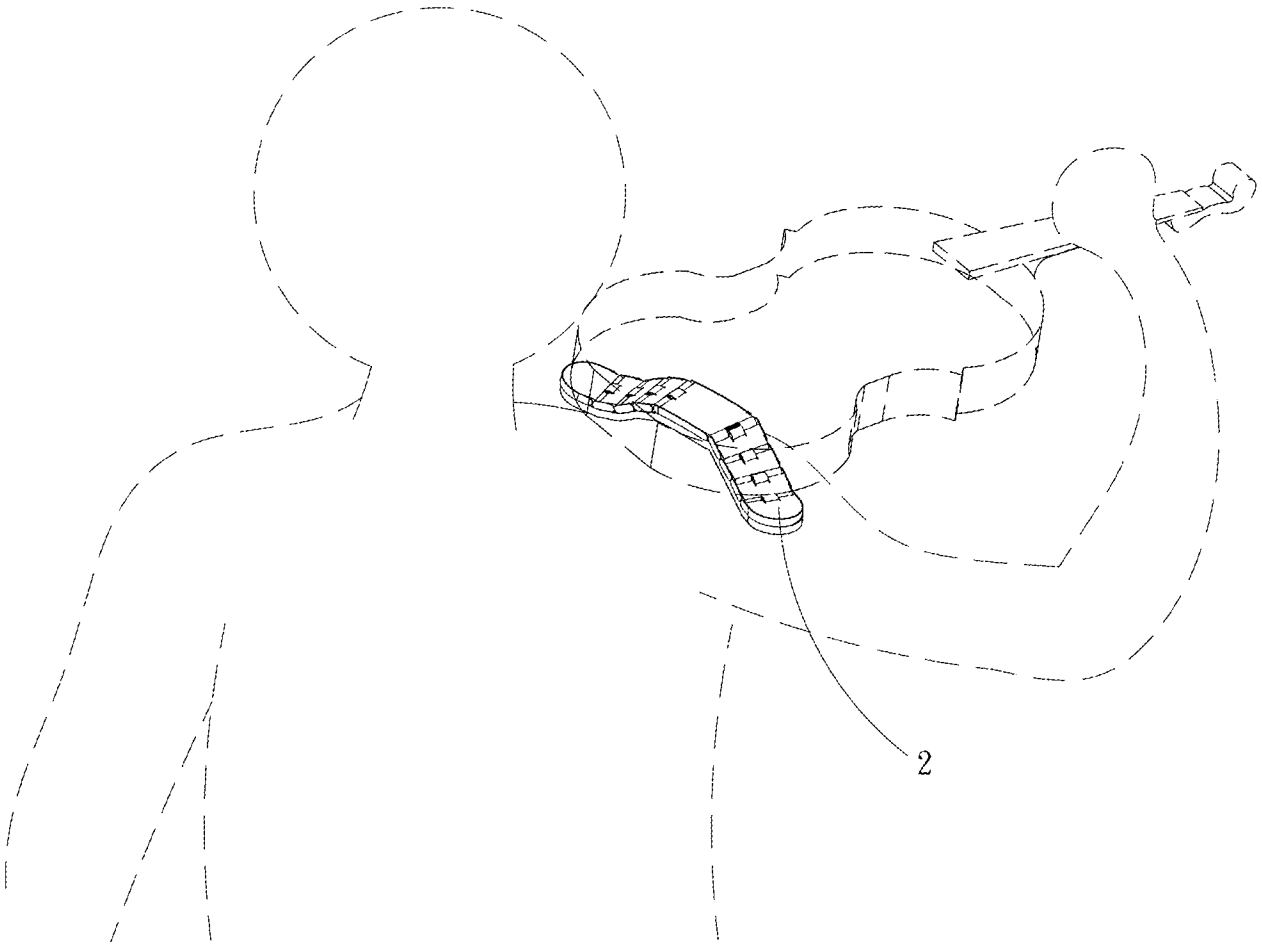
FIG. 5 is a schematic view of the shoulder rest structure for a violin and a viola according to the first embodiment of the present invention in operation.

Please also refer to FIGS. 4 and 5, which are another perspective assembled view of the shoulder rest structure for a violin and a viola according to the first embodiment of the present invention and a schematic view of the shoulder rest structure for a violin and a viola according to the first embodiment of the present invention in operation, respectively. When the practitioner practices the violin, the violin is clamped by the chin and the shoulder and the bow is held by another hand. Because the shoulder rest structure 2 has flexibility, which uses the first connecting part 2111 connecting the first adjustment piece 212, the first counterpart 2112 connecting the second adjustment piece 213, the second adjustment piece 213 connecting the first adjustment piece 212, and the fourth adjustment piece 215 connecting the second adjustment piece 213 such that the first body 21 forms a form of piece by piece to have flexibility and then the first body 21 is attached to the second body 22 correspondingly, the shoulder rest can be adjusted according to the curvatures of the outlines of the shoulders of different practitioners. The adjustment method is to make the first body 21 and the second body 22 attach to the shoulder of the practitioner along the curvature of the outline of the shoulder according to the change of the curvature of the outline of the shoulder of each practitioner, make the second side 222 of the second body 22 contact the shoulder, and provide a most comfortable position for the practitioner. Also, the attachment direction depends on the practitioners preference or the requirement of practice, which can be longitudinal or transversal to the shoulder. In the current embodiment, the shoulder rest structure 2 is attached longitudinally to the shoulder for explanation. As a result, the practitioner will not feel uncomfortable due to tilting the head or raising the shoulder for a long time, which closely meets the ergonomics and makes the practitioner not easy to get tired. At the same time, the shoulder can be relaxed and a correct gesture of holding the violin is obtained, which further extends the effective time and improves the quality of the violin practice, and enhances the sound quality.

Moreover, because the first body has a form of piece by piece, which has functions of assembly and disassembly, the length of the first body is adjustable according to the curvature of the outline or the size of the shoulder of the practitioner.

Figure 6:
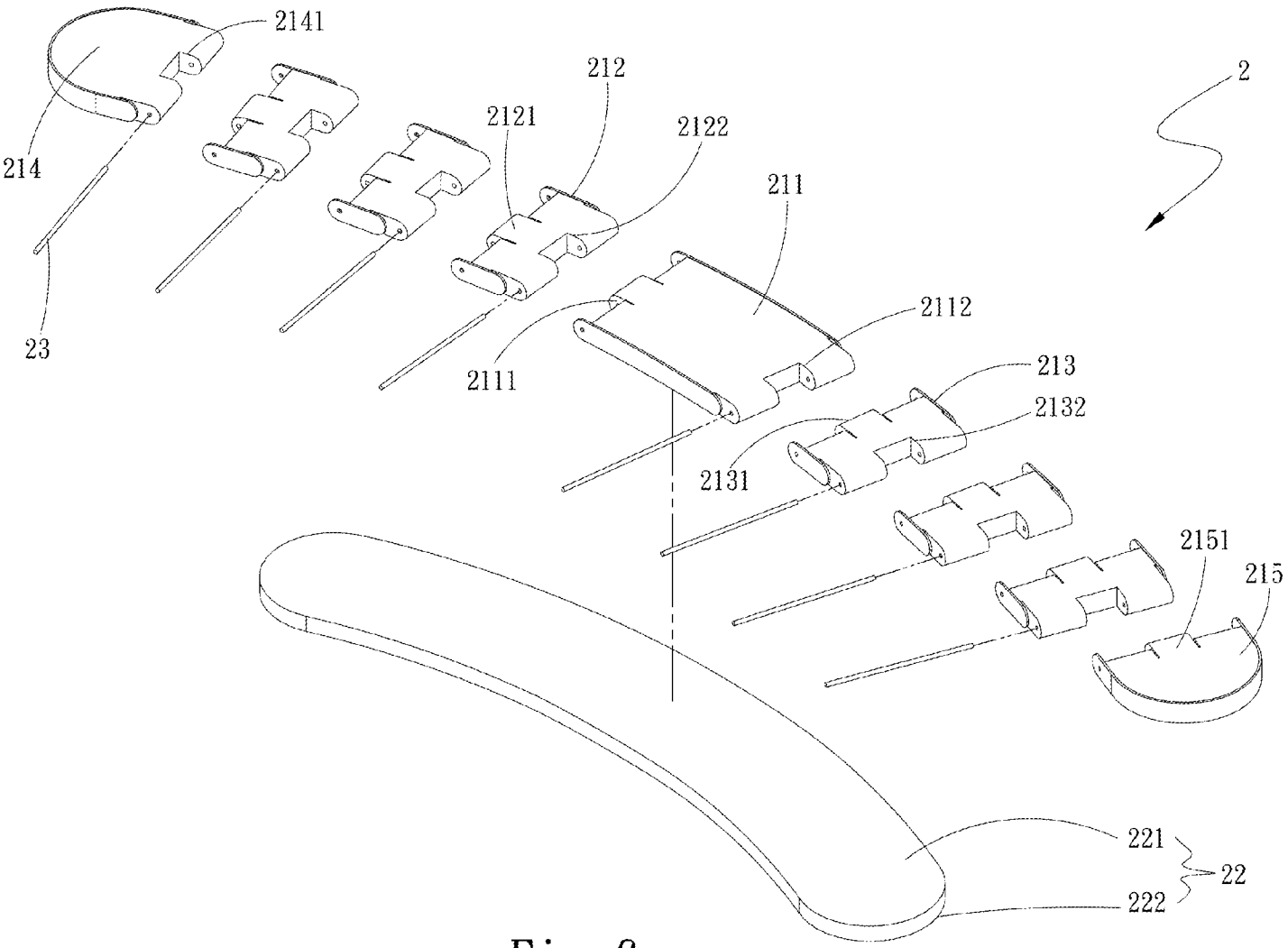
FIG. 6 is a perspective exploded view of the shoulder rest structure for a violin and a viola according to the second embodiment of the present invention.
Figure 7:
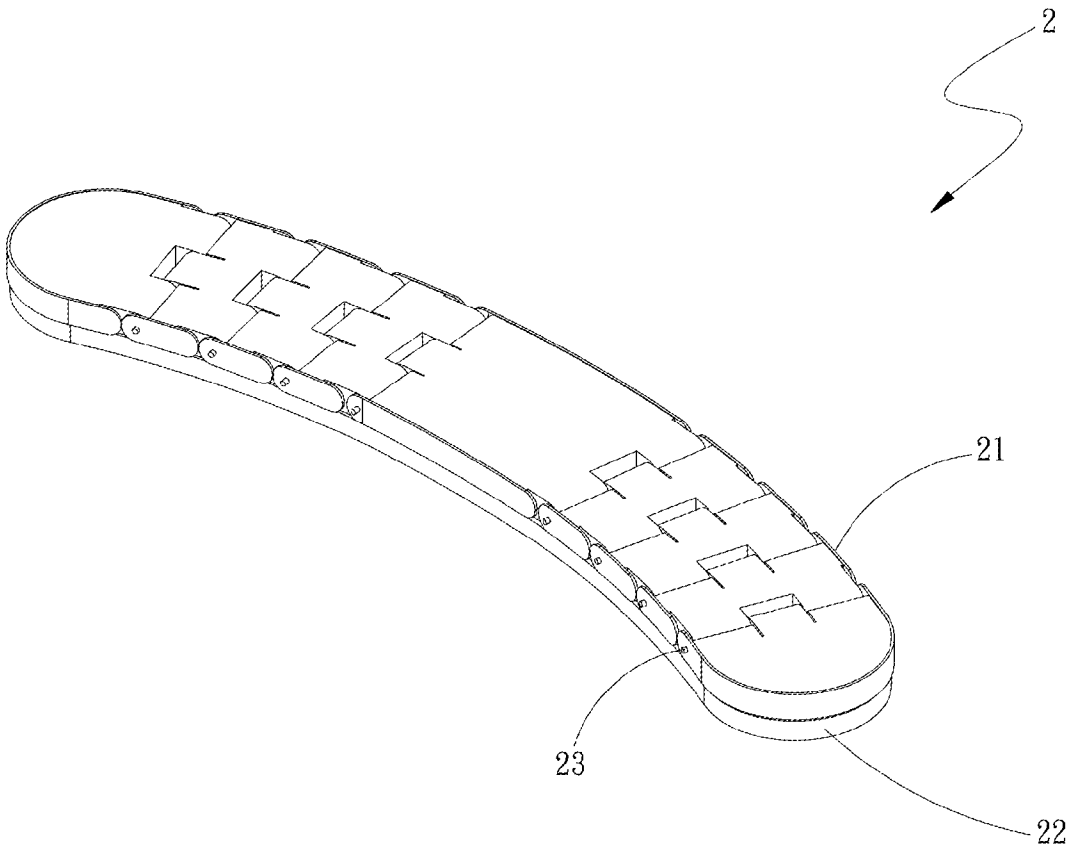
FIG. 7 is a perspective assembled view of the shoulder rest structure for a violin and a viola according to the second embodiment of the present invention.
Figure 8:
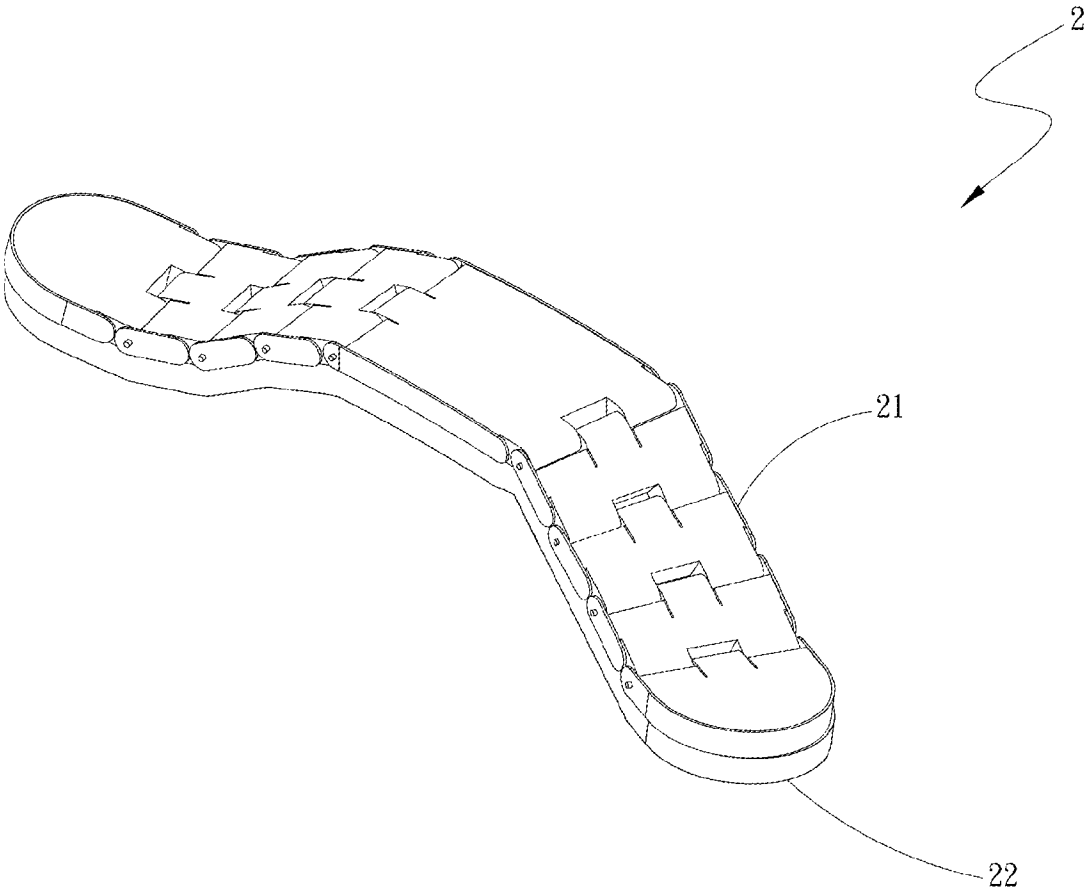
FIG. 8 is another perspective assembled view of the shoulder rest structure for a violin and a viola according to the second embodiment of the present invention.

Please continue to refer to FIGS. 6-8, which are a perspective exploded view, a perspective assembled view, and another perspective assembled view of the shoulder rest structure for a violin and a viola according to the second embodiment of the present invention, respectively. The corresponding relations among some components of the current embodiment are the same as those of the first embodiment and will not be described again here. The main difference is that in the second embodiment, the shoulder rest structure further comprises fasteners 23 penetrating through the joint of the first connecting part 2111 and the second counterpart 2122, through the joint of the first counterpart 2112 and the third connecting part 2131, through the joint of the second connecting part 2121 of the first adjustment piece 212 at the farthest end and the fourth counterpart 2141 of the third adjustment piece 214, and through the joint of the third counterpart 2132 of the second adjustment piece 213 at the farthest end and the fourth connecting part 2151 of the fourth adjustment piece 215. Similarly, using the design of the shoulder rest structure 2 in the second embodiment, when the practitioner practices the violin, the violin is clamped by the chin and the shoulder and the bow is held by another hand. Because the shoulder rest structure 2 has flexibility, the shoulder rest can be adjusted according to different curvatures of the outlines of shoulders. The adjustment method is to make the first body 21 and the second body 22 attach to the shoulder of the practitioner along the curvature of the outline of the shoulder according to the change of the curvature of the outline of the shoulder of each practitioner, make the second side 222 of the second body 22 contact the shoulder, and provide a most comfortable position for the practitioner. As a result, the practitioner will not feel uncomfortable due to tilting the head or raising the shoulder for a long time, which closely meets the ergonomics and makes the practitioner not easy to get tired. At the same time, the shoulder can be relaxed and a correct gesture of holding the violin is obtained, which further extends the effective time and improves the quality of the violin practice, and enhances the sound quality.

In summary, compared with the prior art, the present invention has the following advantages.

1. Meeting the ergonomics to greatly make the violin/viola practice more comfortable.
2. Considerably enhancing the effective time and quality of the violin/viola practice.
3. Having the flexibility to adjust the length of the shoulder rest according to the arc of the human shoulder.
4. Improving the sound quality.

The present invention has been described in detail above. It will be understood that the above description is only about some preferred embodiments of the present invention, which should not limit the scope of the present invention. All equivalent variations and modifications according to the claimed scope of the present invention should be embraced by the scope of the appended claims of the present invention.

What is claimed is:

1. A shoulder rest structure for a violin and a viola, comprising:

a first body having a positioning piece, wherein the positioning piece has a first connecting part and a first counterpart at two ends thereof, wherein the first connecting part connects at least one first adjustment piece and the first counterpart connects at least one second adjustment piece;

a second body having a first side and a second side, wherein the first side attaches to the first body correspondingly; and a third adjustment piece and a fourth adjustment piece, wherein the third adjustment piece correspondingly connects the first adjustment piece and the fourth adjustment piece correspondingly connects the second adjustment piece.

2. The shoulder rest structure according to claim 1, wherein the first adjustment piece has a second connecting part and a second counterpart at two sides thereof and the first connecting part is engaged with the second counterpart correspondingly, wherein the second adjustment piece has a third connecting part and a third counterpart at two sides thereof and the first counterpart is engaged with the third connecting part correspondingly.

3. The shoulder rest structure according to claim 2, wherein the third adjustment piece has a fourth counterpart at a side thereof and the fourth counterpart is engaged with the second connecting part correspondingly, wherein the fourth adjustment piece has a fourth connecting part at a side thereof and the fourth connecting part is engaged with the third counterpart correspondingly.

4. The shoulder rest structure according to claim 3, further comprising a plurality of fasteners penetrating through a joint of the first connecting part and the second counterpart, and through a joint of the first counterpart and the third connecting part.

5. The shoulder rest structure according to claim 4, wherein the fasteners penetrate through a joint of the second connecting part and the fourth counterpart, and through a joint of the third counterpart and the fourth connecting part.

6. The shoulder rest structure according to claim 1, wherein materials of the first body and the second body are metal or nonmetal.

* * * * *